US009340268B2

(12) United States Patent
Choi et al.

(10) Patent No.: US 9,340,268 B2
(45) Date of Patent: May 17, 2016

(54) FLOOR DEVICE CAPABLE OF UP-DOWN MOVEMENT FOR VESSELS

(75) Inventors: In Gi Choi, Geoje-si (KR); D. Scott Brittin, Katy, TX (US)

(73) Assignees: TRANSOCEAN SEDCO FOREX VENTURES LIMITED, George Town, Grand (KY); DAEWOO SHIPBUILDING & MARINE ENGINEERING CO., LTD., Seoul (KR)

( * ) Notice: Subject to any disclaimer, the term of this patent is extended or adjusted under 35 U.S.C. 154(b) by 512 days.

(21) Appl. No.: 13/877,152

(22) PCT Filed: Jun. 20, 2011

(86) PCT No.: PCT/KR2011/004466

§ 371 (c)(1),
(2), (4) Date: Jul. 8, 2013

(87) PCT Pub. No.: WO2012/043966

PCT Pub. Date: Apr. 5, 2012

(65) Prior Publication Data

US 2015/0321741 A1 Nov. 12, 2015

(30) Foreign Application Priority Data

Sep. 29, 2010 (KR) ..... 20-2010-0010048 U

(51) Int. Cl.
*B63H 5/125* (2006.01)
*B63B 11/06* (2006.01)
(Continued)

(52) U.S. Cl.
CPC ..... *B63H 5/125* (2013.01); *B63B 11/06* (2013.01); *B63B 35/00* (2013.01); *B63B 35/44* (2013.01); *B63H 2005/1254* (2013.01)

(58) Field of Classification Search
CPC ..... B63H 5/125; B63B 11/06
USPC ..... 114/54; 440/54
See application file for complete search history.

(56) References Cited

U.S. PATENT DOCUMENTS 1,364,961 A * 1/1921 Thompson ..... B63H 25/38 114/163
2,987,027 A * 6/1961 Wanzer ..... B63H 25/46 114/122

(Continued)

FOREIGN PATENT DOCUMENTS

JP 52-129198 A 10/1977
JP 55-083494 U1 6/1980

(Continued)

OTHER PUBLICATIONS

International Search Report dated Dec. 7, 2011 of PCT/KR2011/004466 which is a parent application—2 pages.

(Continued)

*Primary Examiner* — Lars A Olson
*Assistant Examiner* — Jovon Hayes
(74) *Attorney, Agent, or Firm* — Knobbe Martens Olson & Bear LLP

(57) ABSTRACT

Provided is a floor apparatus which is vertically movable with a thruster canister within a vertical trunk of a hull. The floor apparatus includes a floor frame which is installed in an upper space of a vertical trunk of a ship, that is, a space above a thruster canister. The floor frame is installed to be vertically movable along the vertical trunk. The side of the floor frame is installed to be vertically movable while being guided along the sidewall of the vertical trunk. In particular, at least one pair of guide frames which guide the side of the floor frame are symmetrically installed on the sidewall of the vertical trunk.

13 Claims, 3 Drawing Sheets

(51) Int. Cl.
*B63B 35/00* (2006.01)
*B63B 35/44* (2006.01)

(56) References Cited

U.S. PATENT DOCUMENTS 4,075,971 A * 2/1978 Reginensi ..... B63H 5/125 440/54
5,237,946 A 8/1993 Copson
6,375,524 B1 * 4/2002 Commandeur ..... B63B 35/665 440/54
6,439,936 B1 * 8/2002 Dreith ..... B63B 17/0018 114/144 B
7,641,526 B1 * 1/2010 Bekker ..... B63H 5/125 440/54
7,992,275 B1 * 8/2011 Bekker ..... B63B 9/00 114/265
8,926,382 B2 * 1/2015 Van Der Kam ..... B63B 17/0018 440/54
8,939,806 B2 * 1/2015 Horkko ..... B63H 5/125 440/54
2001/0029133 A1 * 10/2001 Breems ..... B63H 5/1252 440/6

FOREIGN PATENT DOCUMENTS

JP 56-099890 A 8/1981
JP 03-272981 A 12/1991
KR 10-2001-0108293 A 12/2001

OTHER PUBLICATIONS

Office Action dated Feb. 18, 2014 of corresponding Japanese Patent Application No. 2013-530085—3 pages.

* cited by examiner

FLOOR DEVICE CAPABLE OF UP-DOWN MOVEMENT FOR VESSELS

CROSS-REFERENCE(S) TO RELATED APPLICATION

This application claims priority of Korean Utility Model Application No. 20-2010-0010048, filed on Sep. 29, 2010, in the Korean Intellectual Property Office, which is hereby incorporated by reference in its entirety.

BACKGROUND OF THE INVENTION

1. Field of the Invention

The present invention relates to a movable floor apparatus for a ship, and more particularly, to a floor apparatus for a ship, which is installed to be vertically movable with a vertical movement of a thruster canister within a vertical trunk of a hull.

2. Description of the Related Art

A ship is equipped with a thruster assembly for implementation of propulsion and position control. Such a thruster assembly is widely used in a ship which frequently moves its position, like a drill ship.

In particular, a drill ship is configured to have a self position control function of making the ship maintained stably at a predetermined drilling site on the sea, and to make a voyage with its own power. A thruster assembly, one of propulsion systems, is used as essential equipment for implementation of main propulsion and self position control. For example, three thruster assemblies are installed in a bow side of a drill ship, and three thruster assemblies are installed in a stern side thereof. The respective thruster assemblies are provided with 360-degree-rotatable propellers. Therefore, the thruster assembly can provide both the propulsion and the position control to cause the ship to be propelled, reversely propelled or rotated.

A thruster assembly may include an underwater unit with a propeller, and a thruster canister installed on the underwater unit. A driving motor for driving the propeller, a hydraulic system, a lubricating device, and so on, are installed in the thruster canister.

The thruster canister is installed to be vertically movable within a vertical trunk of a hull. When the thruster assembly is repaired or maintained or the ship passes through shallow water, such as a canal, the thruster canister is lifted up within the vertical trunk of the hull.

Meanwhile, an arctic drill ship used in arctic regions is configured such that various loading and unloading operations are carried out within the hull in order to avoid outworking under arctic environments. To this end, a landing floor on which side-dish containers or the like can be landed is required above the vertical trunk in which the thruster assembly is installed, that is, below a main deck of the hull. In particular, it is necessary to configure the landing floor which can avoid interference with a thruster canister which vertically moves within the vertical trunk and can facilitate the loading and unloading operations within the hull.

SUMMARY OF THE INVENTION

An aspect of the present invention is directed to a floor apparatus for a ship, which can facilitate the landing of a container within a trunk which is formed vertically inside a hull.

According to an embodiment of the present invention, a floor apparatus for a ship, which is installed within a vertical trunk of a hull, includes: a floor frame installed to be vertically movable within the vertical trunk, wherein the floor frame interlocks with a thruster canister which is installed to be vertically movable within the vertical trunk, such that the floor frame is vertically moved with the thruster canister within at least a predetermined section.

The ship may be an arctic drill ship, the floor frame ma be installed in an upper space of the vertical trunk which is adjacent to the bottom of a main deck of a hull, and a landing of a container may be carried out on the floor frame, whereby a loading and unloading of a cargo contained in the container is carried out within the hull.

The floor apparatus may further include at least one pair of guide frames installed on a sidewall of the vertical trunk to guide the floor frame.

The floor apparatus may further include at least one pair of support frames provided under the guide frames to support the floor frame and restrict the downward movement of the floor frame, and the support frames may be installed on a sidewall of the vertical trunk.

The floor frame may have a smaller area than that of the top area of the thruster canister, whereby a worker's access to the thruster canister is not disturbed.

The floor apparatus may further include one or more guide posts which are install on the thruster canister and are contactable with the bottom of the floor frame.

The floor apparatus may further include an openable hatch installed in the floor frame.

DETAILED DESCRIPTION OF EXEMPLARY EMBODIMENTS

Figure 1:
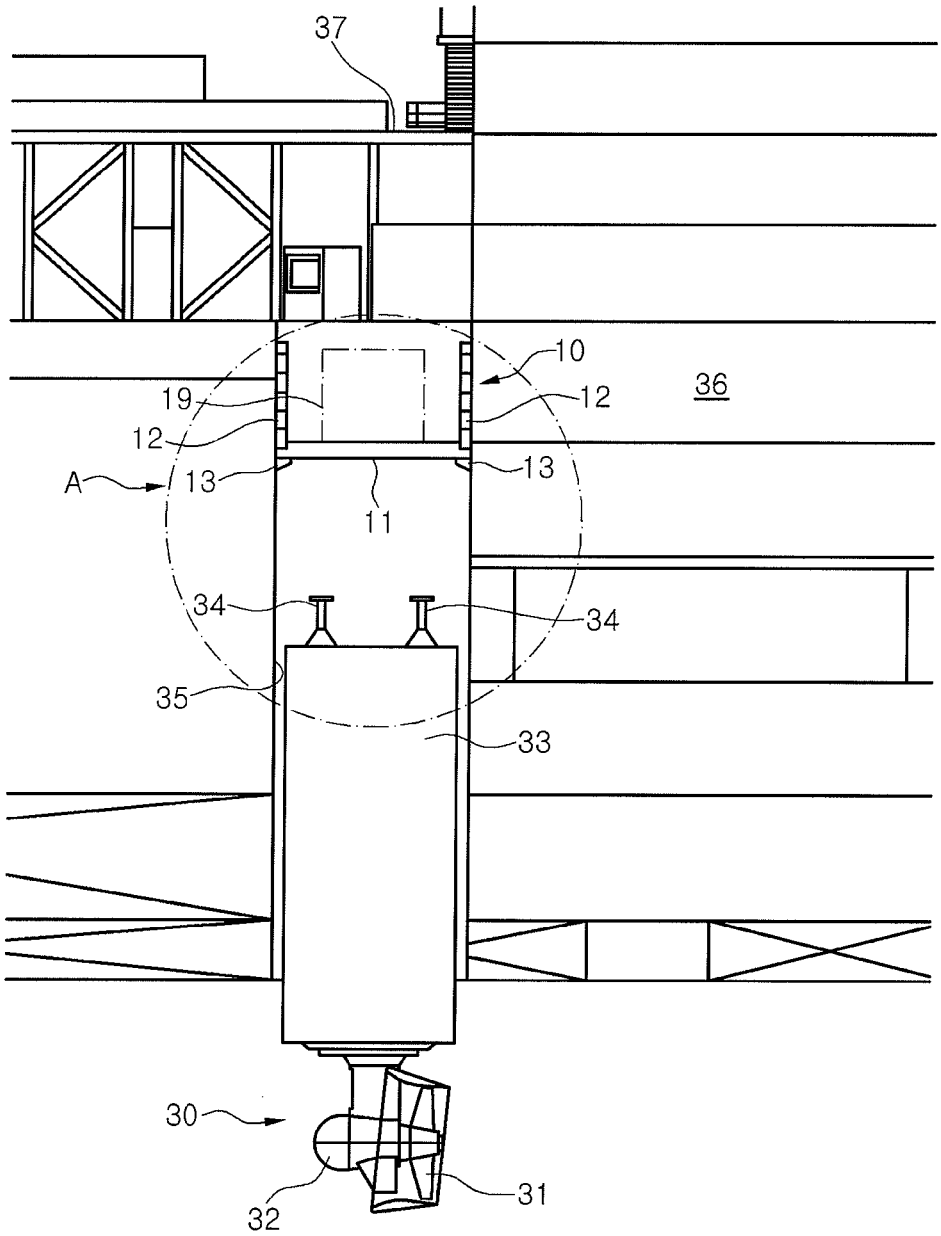
FIG. 1 is a configuration diagram of a floor apparatus for a ship according to an embodiment of the present invention.

Exemplary embodiments of the present invention will be described below in detail with reference to the accompanying drawings. Throughout the disclosure, like reference numerals refer to like parts throughout the drawings and embodiments of the present invention.

FIGS. 1 to 4 illustrate a floor apparatus for a ship according to an embodiment of the present invention. As illustrated in FIG. 1, a plurality of thruster assemblies 30 are installed in a bow and a stern of a ship, for example, a drill ship. The thruster assembly 30 includes an underwater unit 32 with a propeller 31, and a thruster canister 33 installed on the underwater unit 32. A driving motor for driving the propeller 31, a hydraulic system, a lubricating device, and so on, are installed in the thruster canister 33.

At the bow and stern sides inside the ship, a watertight vertical trunk 35 is vertically formed, and an opening is formed at the bottom of the vertical trunk 35. The underwater unit 32 of the thruster assembly 30 is exposed to the lower portion of the ship through the opening of the vertical trunk 35, and the thruster canister 33 is installed to be vertically movable within the vertical trunk 35. When the thruster assembly 30 is repaired or maintained or the ship passes through shallow water, such as a canal, the thruster canister 33 and the underwater unit 32 are moved upwardly and lifted up within the vertical trunk 35. The vertical movement of the thruster canister 33 may be implemented by a driving mechanism, such as a rack and pinion, which is installed between the thruster canister 33 and the vertical trunk 35. The driving mechanism enabling the vertical movement of the thruster canister may be implemented using any known technique, and it does not limit the present invention.

A floor apparatus 10 according to the present invention is installed in an upper space of the vertical trunk 35, that is, a region adjacent to the bottom of a main deck 37 of a hull.

The floor apparatus 10 according to the present invention includes a floor frame 11 installed in the upper space of the vertical trunk 35, that is, above the thruster canister 33. The floor frame 11 is installed to be vertically movable along the vertical trunk 35.

A warehouse 36 such as a store is adjacent to the upper space of the vertical trunk 35. In the case of an arctic drill ship which is exposed to an extremely low temperature environment, it is preferable that various loading and unloading operations are carried out within the hull due to a harsh environment. Therefore, the floor frame 11 is installed such that various loading and unloading operations are carried out from the upper space of the vertical trunk 35 toward the warehouse 36. A container 19 containing various side dishes may be landed on the floor frame 11. When the loading and unloading of the side dishes are completed, the container 19 is removed from the floor frame 11. Thus, no containers are present on the floor frame 11 most of the time during the voyage of the ship. As such, since the space above the floor frame 11 is empty most of the time, interference caused by the container does not occur even though the floor frame 11 is moved upwardly when the thruster canister 33 is moved upwardly.

The floor frame 11 is installed such that the side of the floor frame 11 is vertically moved while being guided along the sidewall of the vertical trunk 35. In particular, at least one pair of guide frames 12 which guide the side of the floor frame 11 are symmetrically installed on the sidewall of the vertical trunk 35.

Figure 2:
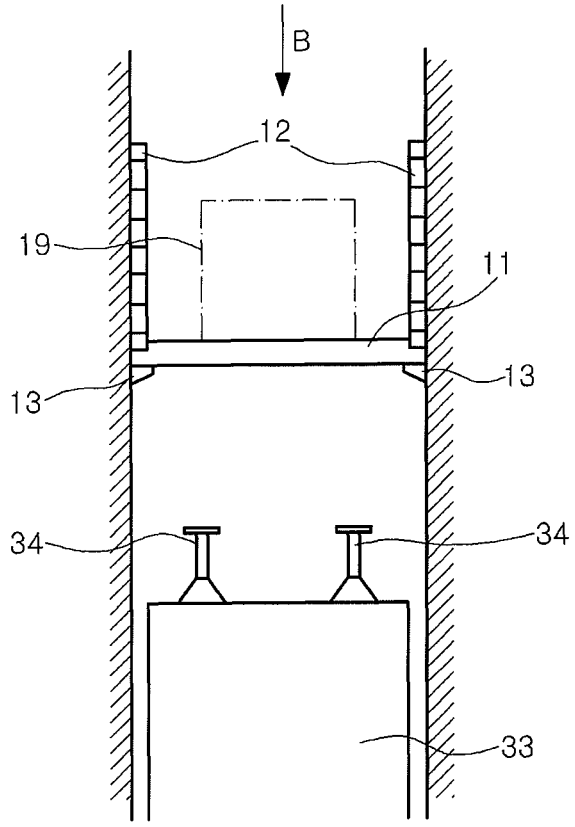
FIG. 2 is an enlarged view of a portion indicated by an arrow A of FIG. 1.

Support frames 13 are installed under the guide frames 12. The support frames 13 may be provided with at least one pair of support frames installed on the sidewall of the vertical trunk 35. As illustrated in FIGS. 1 and 2, the support frames 13 can firmly support lower edge sides of the floor frame 11 when the floor frame 11 is located at the lowermost position. Preferably, the guide frames 12 are configured such that they are not interfered with the thruster canister 33 during the upward movement of the thruster canister 33.

Figure 4:
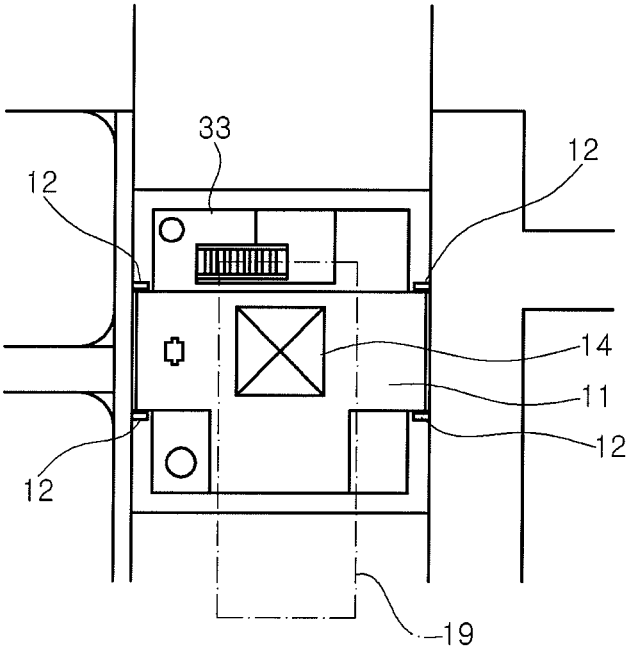
FIG. 4 is a plan view looked in a direction of an arrow B of FIG. 2.

The floor frame 11 is installed to avoid interference with structures disposed on the thruster canister 33. In particular, as illustrated in FIG. 4, the floor frame 11 may be formed to have a smaller area than that of the top surface of the thruster canister 33. Such a configuration makes it easy for a worker to access the thruster canister 33. That is, since the floor frame 11 does not completely block a passage for the thruster canister 33, a worker can easily access the thruster canister 33. Although FIG. 4 illustrates that the floor frame 11 has an approximately T shape, the shape of the floor frame 11 according to the present invention is not limited thereto.

In addition, one or more hatches 14 are openably installed in the floor frame 11. The hatches 14 may be used as a passage through which a worker accesses the thruster canister 33 in order for maintenance of equipments. A hand rail and a grating plate may be further provided on the floor frame 11 for the purpose of safety.

As illustrated in FIGS. 1 and 2, when the thruster assembly 30 is moved downwardly within the vertical trunk 35, that is, the underwater unit 32 of the thruster assembly 30 protrudes below the hull, the floor frame 11 and the thruster canister 33 are spaced apart from each other by a predetermined distance.

Figure 3:
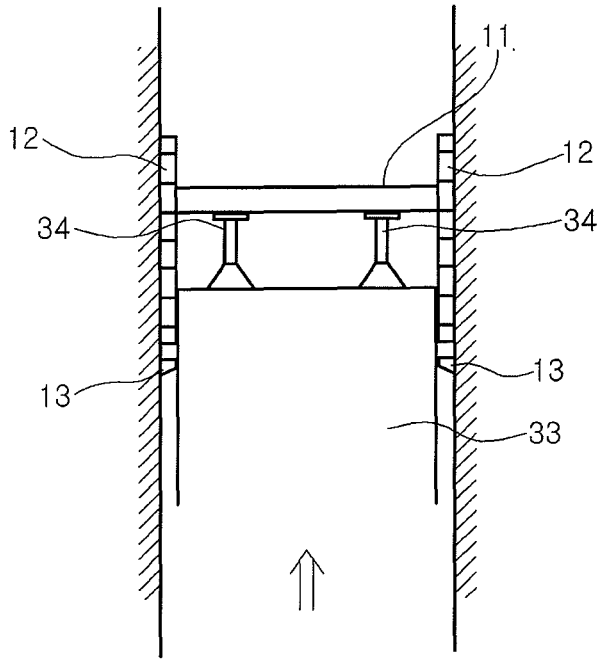
FIG. 3 is a view illustrating a state in which the floor apparatus for the ship according to the embodiment of the present invention is moved upwardly by a thruster canister.

When the thruster assembly 30 is moved upwardly, as illustrated in FIG. 3, the thruster canister 33 is close to the bottom surface of the floor frame 11 and pushes up the floor frame 11 while the top surface of the thruster canister 33 contacts the bottom surface of the floor frame 11. Accordingly, the floor frame 11 is moved upwardly.

According to one embodiment, one or more guide posts 34 may be installed on the top surface of the thruster canister 33. When the thruster canister 33 is moved upwardly and is close to the bottom surface of the floor frame 11, the guide posts 34 contact the bottom surface of the floor frame 11. Accordingly, the floor frame 11 is easily moved upwardly while interlocking with the upward movement of the thruster canister 33.

The guide posts 34 may be replaced with shock absorbing members (e.g., rubber) which are installed on the top surface of the thruster canister 33.

If the thruster canister 33 is moved downwardly in the state of FIG. 3, the floor frame 11 is moved downwardly while being stably supported by the guide posts 34 of the thruster canister 33.

The floor frame 11 may be configured to move together in an entire section or at least a predetermined section of the vertical movement of the thruster canister 33. If the floor frame 11 moves together in a predetermined section, as illustrated in FIG. 2, the floor frame 11 and the thruster canister 33 do not contact each other when the thruster canister 33 is moved downwardly. However, as illustrated in FIG. 3, the thruster canister 33 contacts the floor frame 11 on the way while the thruster canister 33 moves upwardly. Then, the thruster canister 33 moves together with the floor frame 11 while pushing up the floor frame 11. At this time, when the thruster canister 33 is moved downwardly, the downward movement of the floor frame 11 may be restricted by the support frames 13.

According to the embodiments of the present invention, since the floor apparatus disposed above the thruster canister is configured to vertically move with the vertical movement of the thruster canister within the vertical trunk of the hull, it is easy to land the container within the vertical trunk. Therefore, the loading and unloading operation within the hull can be facilitated in a harsh environment such as an arctic region.

While the embodiments of the present invention has been described with reference to the specific embodiments, it will be apparent to those skilled in the art that various changes and modifications may be made without departing from the spirit and scope of the invention as defined in the following claims.

What is claimed is:

1. A ship a vertical trunk provided within a hull of the ship and comprising sidewalls;

a thruster canister engaged with the vertical trunk and movable along a vertical direction within the vertical trunk; and an elevator floor positioned above and separate from the thruster canister, the elevator floor movable along the vertical direction within the vertical trunk, wherein the thruster canister is configured to push the elevator floor from below for moving the elevator floor between a first level and a second level.

2. The ship according to claim 1, wherein the ship is an arctic drill ship, the first and second levels are located below a main deck of the ship, and the elevator floor is configured to transport cargo between the first and second levels.

3. The ship according to claim 1, further comprising guide frames connecting the elevator floor to at least one sidewall of the vertical trunk to guide the elevator floor along the at least one sidewall of the vertical trunk.

4. The ship according to claim 1, further comprising floor stops extending from at least one sidewall of the vertical trunk, wherein the floor stops are configured to support the elevator floor and restrict downward movement of the elevator floor below the second level when the thruster canister is at a level where the at least one floor support does not push the elevator floor.

5. The ship according to claim 1, wherein a top surface of the elevator floor has a smaller area than a top surface of the thruster canister.

6. The ship according to claim 1, wherein the at least one floor support is positioned on a top surface of the thruster canister and configured to contact a bottom surface of the elevator floor when the thruster canister pushes the elevator floor between the first and second levels.

7. The ship according to claim 1, further comprising an openable hatch through the elevator floor to provide access to a top surface of the thruster canister.

8. The ship according to claim 1, wherein the elevator floor is separated from the thruster canister when a bottom end of the thruster canister is positioned below the hull.

9. The ship according to claim 1, wherein the at least one floor support further comprises shock absorbing members, wherein the shock absorbing members contact a bottom surface of the elevator floor when the thruster canister pushes the non-driven elevator floor between the first and second levels.

10. The ship according to claim 9, wherein the shock absorbing members are formed from rubber.

11. The ship according to claim 5, wherein the elevator floor has a T-shape when viewed in a direction perpendicular to the top surface of the elevator.

12. The ship of claim 1, further comprising at least one shock absorbing member provided between the thruster canister and the elevator floor, wherein the at least one shock absorbing member is configured to be in contact with or separated from the elevator floor as the thruster canister moves along the vertical direction.

13. The ship of claim 12, further comprising at least one floor support provided between the thruster canister and the elevator floor, wherein the at least one floor support is configured to be in contact with or separated from the elevator floor as the thruster canister moves along the vertical direction, wherein the at least one floor support comprises the at least one shock absorbing member.

* * * * *